US010162287B2

(12) United States Patent
Takahashi

(10) Patent No.: US 10,162,287 B2
(45) Date of Patent: Dec. 25, 2018

(54) TONER CASE AND IMAGE FORMING APPARATUS

(71) Applicant: KYOCERA Document Solutions Inc., Osaka (JP)

(72) Inventor: Akinari Takahashi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/810,606

(22) Filed: Nov. 13, 2017

(65) Prior Publication Data

US 2018/0136587 A1 May 17, 2018

(30) Foreign Application Priority Data

Nov. 15, 2016 (JP) ..... 2016-222602

(51) Int. Cl.
*G03G 15/08* (2006.01)

(52) U.S. Cl.
CPC . *G03G 15/0891* (2013.01); *G03G 2215/0827* (2013.01)

(58) Field of Classification Search
CPC ..... G03G 15/0891; G03G 15/0887; G03G 15/0889; G03G 2215/0827
See application file for complete search history.

(56) References Cited

U.S. PATENT DOCUMENTS

2008/0170887 A1* 7/2008 Nishimura ..... G03G 15/0896 399/262
2016/0054683 A1* 2/2016 Torimoto ..... G03G 15/0891 399/263

FOREIGN PATENT DOCUMENTS

JP 2006-284776 10/2006

* cited by examiner

*Primary Examiner* — Sophia S Chen
(74) *Attorney, Agent, or Firm* — Wenderoth, Lind & Ponack, L.L.P.

(57) ABSTRACT

A toner case includes an accommodating unit that accommodates toner, a conveying member that is arranged in the accommodating unit, has a shaft body and a spiral part protruding in a spiral shape from one end side to the other end side of the shaft body, has a recess across whole circumference in a circumferential direction at a portion of the other end side than an end of one end side portion of the shaft body, and rotates in a predetermined direction to convey the toner from the one end side to the other end side, the one end side facing the other end side, and a slide bearing that is provided in the accommodating unit, has a cylindrical shape, and surrounds the one end side portion.

6 Claims, 14 Drawing Sheets

TONER CASE AND IMAGE FORMING APPARATUS

CROSS-REFERENCE TO RELATED APPLICATION

This application is based upon and claims the benefit of priority from Japanese Patent Application No. 2016-222602 filed on Nov. 15, 2016, the entire contents of which are incorporated herein by reference.

BACKGROUND

The technology of the present disclosure relates to a toner case and an image forming apparatus.

In an electrophotographic image forming apparatus such as a copy machine and a printer, for example, a latent image on a carrying member is developed as a toner image by using toner accommodated in a toner case (a toner container) and supplied to a developing device from the toner case.

In an example of this type of image forming apparatus, a cartridge case (a toner case) includes a conveyance screw (a conveying member) for conveying toner accommodated therein. The conveyance screw is mounted between both end walls of a case body so as to freely rotate. One end of a rotating shaft constituting the conveyance screw protrudes through the end wall of the case body and is fixed to an input gear. Furthermore, a portion of the other end side of the rotating shaft is fitted into a recess formed in the end wall.

SUMMARY

A toner case according to one aspect of the present disclosure includes an accommodating unit, a conveying member, and a slide bearing. The accommodating unit accommodates toner. The conveying member is arranged in the accommodating unit and has a shaft body and a spiral part protruding in a spiral shape from one end side to the other end side of the shaft body. The conveying member is formed with a recess across the whole circumference in a circumferential direction at a portion of the other end side than an end of one end side portion of the shaft body. The conveying member rotates in a predetermined direction to convey the toner from the one end side to the other end side. The slide bearing is provided in the aforementioned accommodating unit, has a cylindrical shape, and surrounds the one end side portion.

An image forming apparatus according to another aspect of the present disclosure includes a carrying member, a toner case, a developing device, a transfer device, and a fixing device. The carrying member carries a latent image. The developing device develops the latent image carried by the aforementioned carrying member as a toner image by using toner supplied from the aforementioned toner case. The transfer device transfers the aforementioned toner image developed to the aforementioned carrying member by the aforementioned developing device to a medium. The fixing device fixes the aforementioned toner image, which has been transferred to the aforementioned medium, to the aforementioned medium.

DETAILED DESCRIPTION

Outline

Figure 1:
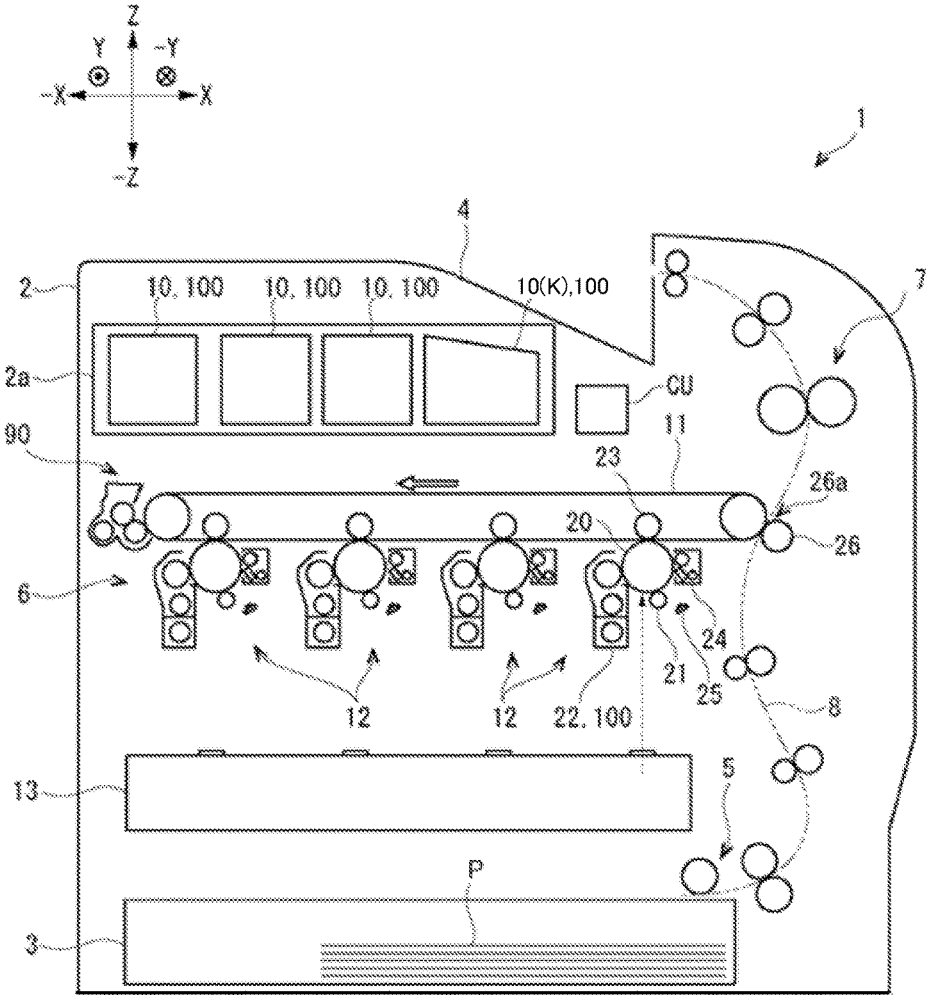
FIG. 1 is a schematic diagram when an image forming apparatus of a first embodiment is viewed from a front surface.

Hereinafter, first and second embodiments will be described in a writing order thereof.

First Embodiment

Hereinafter, a first embodiment will be described. Hereinafter, an entire configuration of an image forming apparatus 1 (see FIG. 1) of the present embodiment, an image forming operation by the image forming apparatus 1, a configuration of a toner container 10 (which is a main element of the present embodiment and see FIG. 3 to FIG. 9), an operation of the toner container 10 of the present embodiment, and an effect of the present embodiment will be described in a writing order thereof with reference to the drawings.

In the following description, it is assumed that directions indicated by an arrow X and an arrow −X respectively indicate a right direction and a left direction, directions indicated by an arrow Y and an arrow −Y respectively indicate a front direction and a rear direction, and directions indicated by an arrow Z and an arrow −Z respectively indicate an up direction (an upper side) and a down direction (a lower side) in the drawings. Furthermore, a description will be provided on the assumption that a state when the image forming apparatus 1 is viewed from a front side in the front and rear direction is a front surface of the image forming apparatus 1. Furthermore, an "upstream", a "downstream", and terms similar to them indicate an "upstream", a "downstream", and concepts similar to them in a toner conveyance direction.

<Entire Configuration>

The entire configuration of the image forming apparatus 1 of the present embodiment will be described with reference to FIG. 1 unless otherwise specifically noted. The image forming apparatus 1 of the present embodiment includes an apparatus body 2, a sheet feeding cassette 3, a sheet discharge tray 4, and a control device CU. The apparatus body 2 has a box shape. The sheet feeding cassette 3 is arranged at a lower portion of the apparatus body 2. The sheet discharge tray 4 is arranged at an upper portion of the apparatus body 2.

Furthermore, the apparatus body 2 has a conveying unit 5, an image forming unit 6, and a fixing unit 7 therein. The conveying unit 5 is configured to send out a medium P in the sheet feeding cassette 3 toward a conveyance path 8 extending from the sheet feeding cassette 3 to the sheet discharge tray 4. The image forming unit 6 is arranged at an intermediate part of the conveyance path 8. The fixing unit 7 is arranged at a downstream side of the conveyance path 8.

The image forming unit 6 includes four toner containers 10 (an example of a toner case), an intermediate transfer belt 11, four drum units 12, and an exposure device 13. The four toner containers 10 are arranged below the sheet discharge tray 4 in the right and left direction. The intermediate transfer belt 11 is circularly movable below each of the toner containers 10 in a direction indicated by a white arrow. The four drum units 12 are arranged under the intermediate transfer belt 11 in the right and left direction. The exposure device 13 is arranged below each of the drum units 12.

The four toner containers 10 accommodate four colors (yellow, magenta, cyan, and black) of toner. In addition, toner of the present embodiment is a so-called one component developer configured with magnetic toner as an example; however, the toner may be a two-component developer including toner and carrier.

The four drum units 12 are provided in correspondence with each color of toner. Each of the drum units 12 includes a photosensitive drum 20 (an example of a carrying member), a charging device 21, a developing device 22, a primary transfer roller 23, a cleaning device 24, and an electricity removing device 25. Since the four drum units 12 have a similar configuration, one drum unit 12 will be described below.

The photosensitive drum 20 has a cylindrical shape rotatable around a shaft. The photosensitive drum 20 contacts with a lower side surface of the intermediate transfer belt 11. The charging device 21, the developing device 22, the primary transfer roller 23, the cleaning device 24, and the electricity removing device 25 are arranged around the photosensitive drum 20 in a writing order thereof. In the image forming unit 6, the photosensitive drum 20 rotating around the shaft is charged by the charging device 21, the photosensitive drum 20 is exposed by the exposure device 13 to form a latent image, the latent image is developed as a toner image by the developing device 22, and the toner image is transferred to the medium P by a secondary transfer roller 26. That is, the photosensitive drum 20 has a function of carrying the latent image.

The developing device 22 is configured to be connected to the toner container 10 and to receive toner from the toner container 10. In the present embodiment, a combination of the toner container 10 for each color and the corresponding developing device 22 for each color is assumed as a toner supply device 100.

The primary transfer roller 23 is arranged at an upper side of the photosensitive drum 20 while interposing the intermediate transfer belt 11 therebetween. At a right side of the intermediate transfer belt 11, the secondary transfer roller 26 is arranged to form a secondary transfer nip part 26*a*. In the present embodiment, a combination of the primary transfer roller 23, the intermediate transfer belt 11, and the secondary transfer roller 26 is assumed as a transfer device 90. The transfer device 90 has a function of transferring the toner image developed to the photosensitive drum 20 to the medium P.

The fixing unit 7 has a function of fixing the toner image to the medium P to which the toner image has been transferred by the secondary transfer roller 26.

The control device CU has a function of receiving image data from an external device (not illustrated) and controlling each element constituting the image forming apparatus 1 on the basis of the image data. Detailed functions of the control device CU will be described while describing an image forming operation and an operation of the toner container 10, which will be described later.

<Image Forming Operation>

Next, the image forming operation of the image forming apparatus 1 will be described. The control device CU of the image forming apparatus 1 controls each element to perform the image forming operation on the basis of the inputted image data as will be described below.

Each charging device 21 charges the surface of each photosensitive drum 20. The exposure device 13 performs exposure (see a dashed line arrow of FIG. 1) corresponding to image data toward each photosensitive drum 20. Each developing device 22 develops the latent image formed on each photosensitive drum 20 as the toner image. The toner image carried on each photosensitive drum 20 is sequentially and primarily transferred to the circularly moving intermediate transfer belt 11 by the primary transfer roller 23 with a primary transfer bias applied thereto. In this way, a full color toner image is formed on the surface of the intermediate transfer belt 11.

On the other hand, the medium P supplied from the sheet feeding cassette 3 is conveyed along the conveyance path 8 and passes through the secondary transfer nip part 26*a*. The full color toner image is secondarily transferred to the medium P by the secondary transfer roller 26 with a secondary transfer bias applied thereto. Next, the fixing unit 7 fixes the full color toner image to the medium P. Next, the medium P with the fixed toner image is discharged to the sheet discharge tray. By so doing, the image forming operation of the present embodiment is ended.

<Configuration of Main Element (Toner Container)>

Next, with reference to FIG. 1, and FIG. 3 to FIG. 8, each toner container 10 will be described. Each toner container 10 has a function of accommodating toner to be supplied to each developing device 22.

As illustrated in FIG. 1, the apparatus body 2 is provided at an upper portion thereof with a mounting part 2*a* for mounting the four toner containers 10 in the right and left direction. Each toner container 10 is supported to the mounting part 2*a* in a slidable state in the front and rear direction. The apparatus body 2 is provided at an upper front surface thereof with an opening/closing cover (not illustrated) for opening and closing the mounting part 2*a*. A user opens the opening/closing cover, thereby performing an attachment/detachment operation of each toner container 10 with respect to the mounting part 2*a*.

Among the four toner containers 10, the toner containers 10 for accommodating the toner of each color (yellow, magenta, and cyan) except for black (K) have the same capacity and specification. In contrast, the toner container 10 (K) for accommodating the black toner is different from the other toner containers 10 in that it is larger than the other toner containers 10 (see FIG. 1 and FIG. 3) and has a larger toner accommodating capacity; however, the toner container 10 (K) has a configuration equal to those of the other toner containers 10 except for the above. Hereinafter, the toner container 10 for accommodating the black toner will be described.

Figure 4:
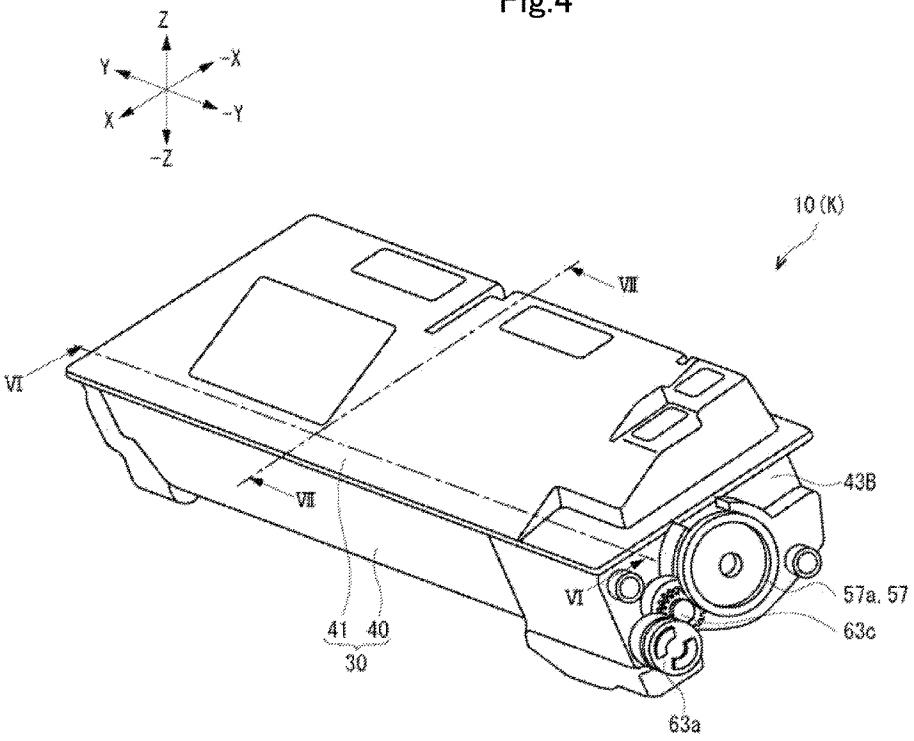
FIG. 4 is a perspective view of a toner container constituting an image forming apparatus of a first embodiment.
Figure 5:
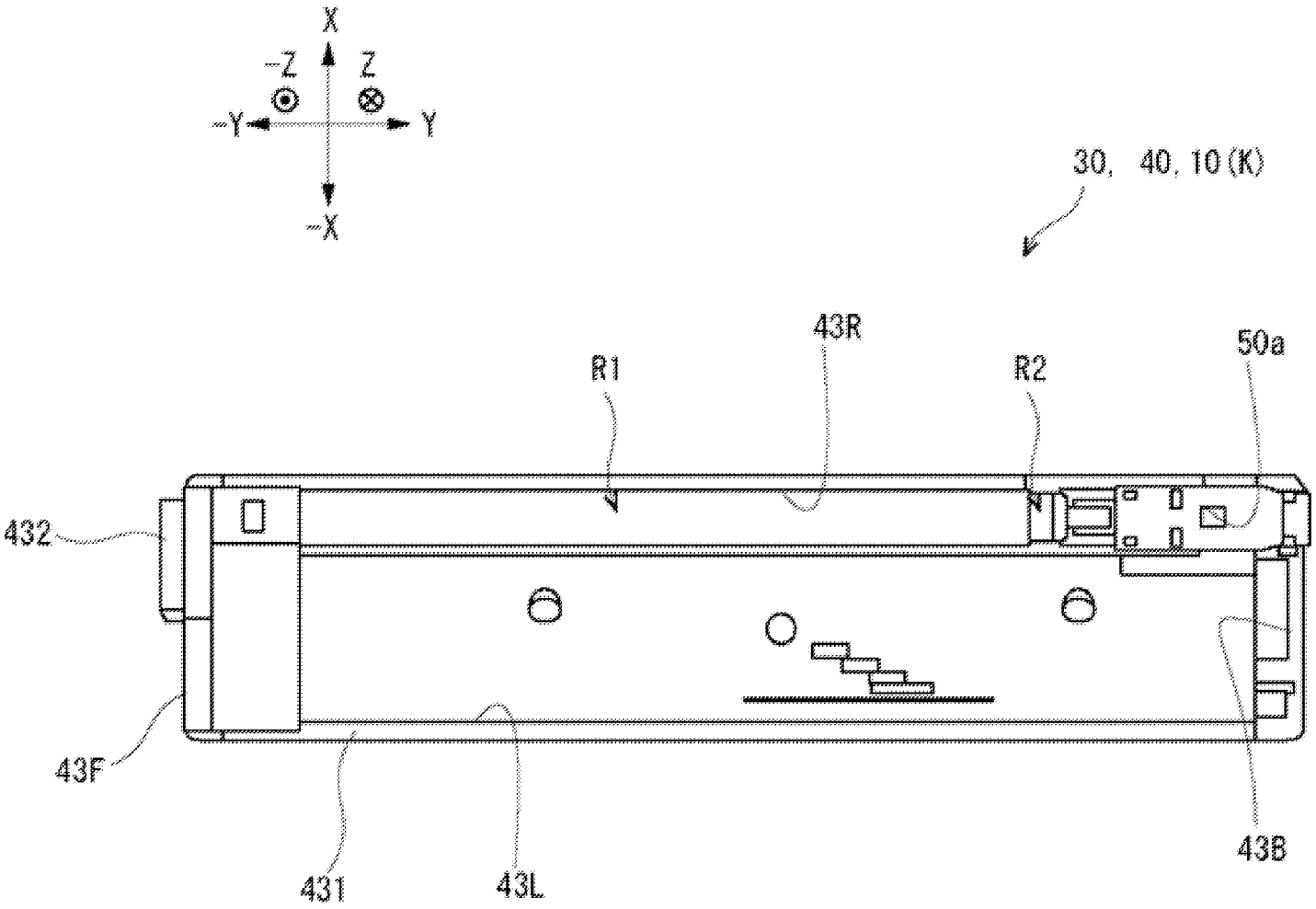
FIG. 5 is a bottom view of a storage vessel part constituting a toner container of a first embodiment.
Figure 6:
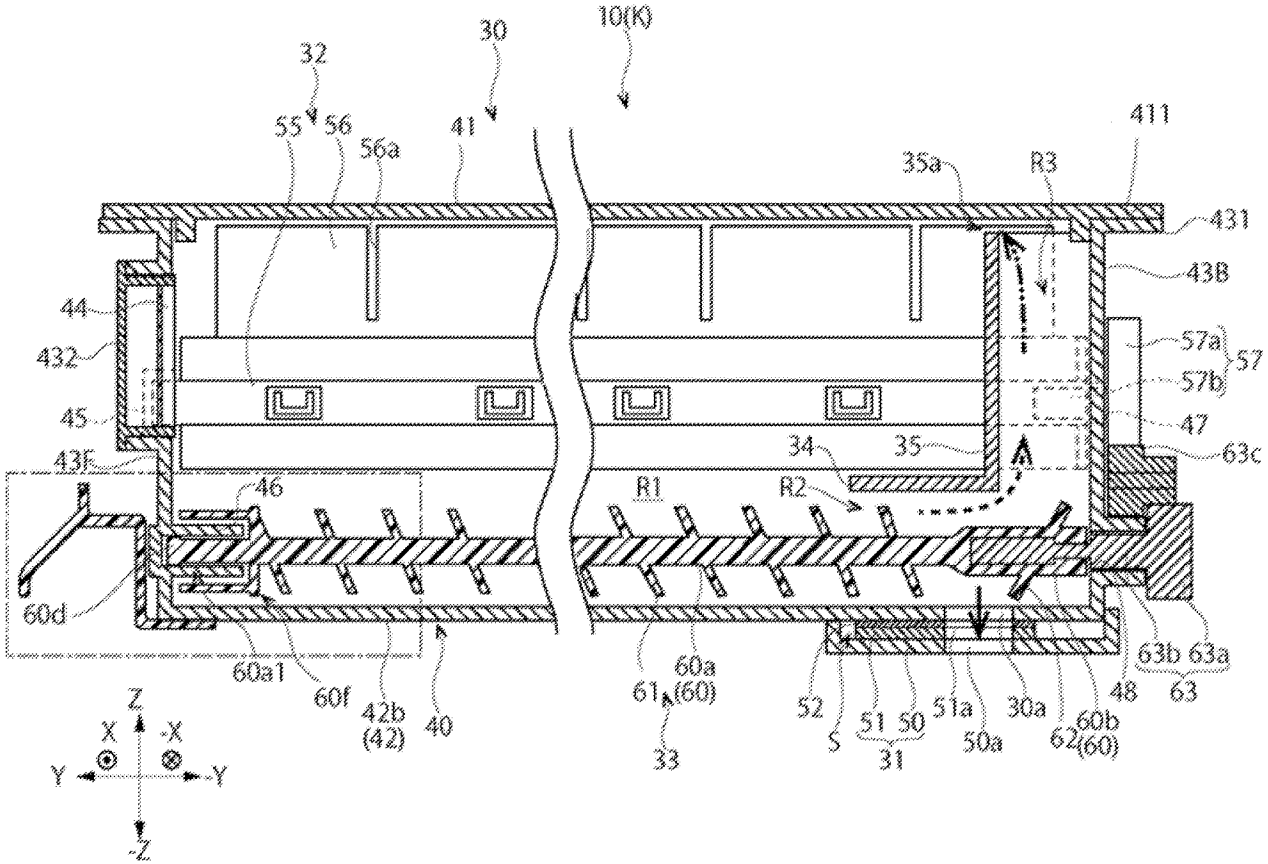
FIG. 6 is a sectional view taken along a cut line VI-VI of FIG. 4.
Figure 7:
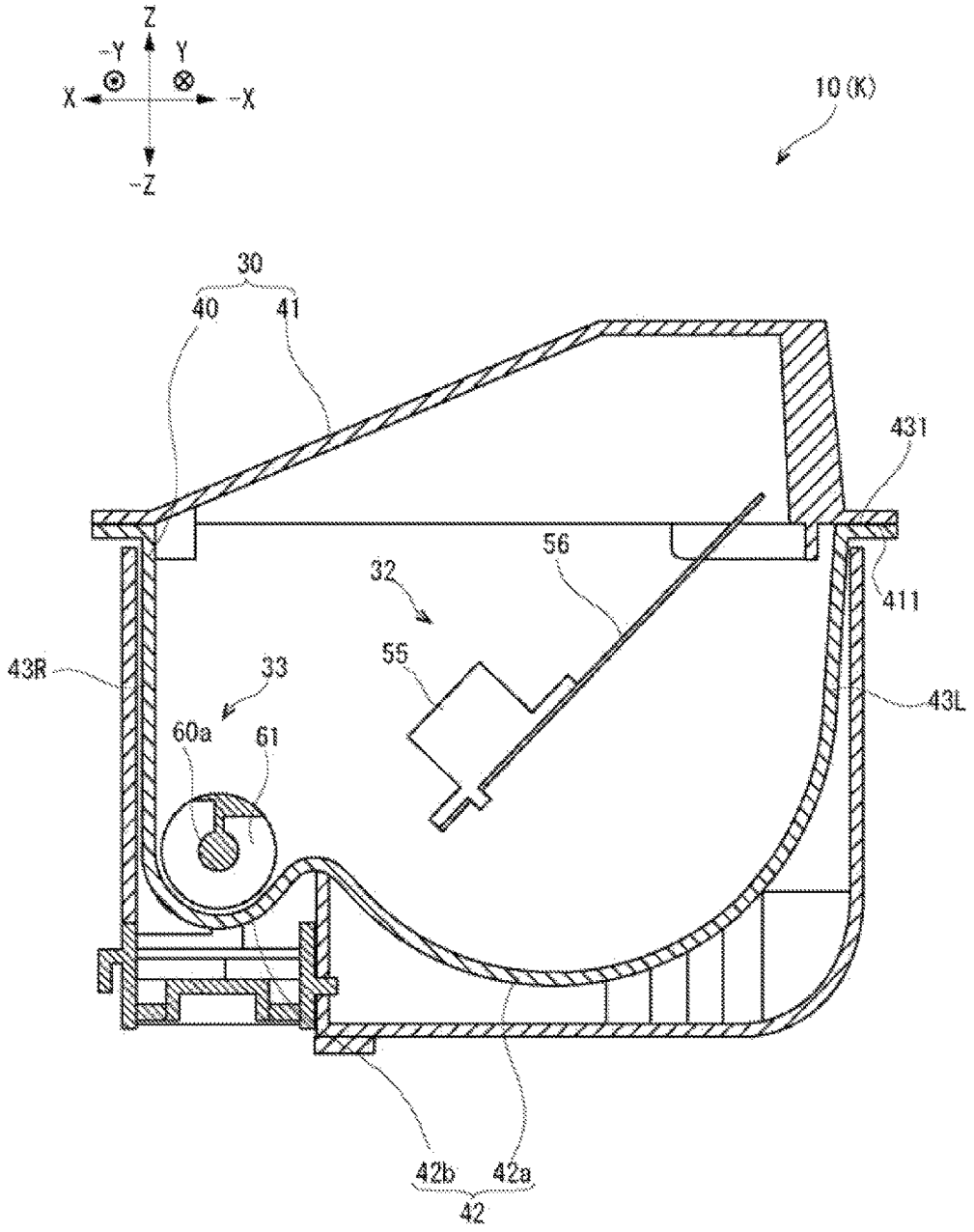
FIG. 7 is a sectional view taken along a cut line VII-VII of FIG. 4.

The toner container 10 includes a vessel body 30 (an example of an accommodating unit), a shutter mechanism 31, a stirring member 32, a conveying member 33, a first cylindrical part 34, and a second cylindrical part 35 as illustrated in FIG. 3 to FIG. 8 (see FIG. 6 and FIG. 7 mainly). The vessel body 30 accommodates toner and has a discharge port 30*a* (an example of a through hole) for discharging the toner to the developing device 22. The shutter mechanism 31 is provided in order to open and close the discharge port 30*a* of the vessel body 30. The stirring member 32 has a function of stirring the toner in the vessel body 30. The conveying member 33 has a function of conveying the toner in the vessel body 30 toward the discharge port 30*a*. The first cylindrical part 34 and the second cylindrical part 35 are provided in the vessel body 30.

[Vessel Body]

The vessel body 30 has an approximately rectangular parallelepiped shape long in the front and rear direction as illustrated in FIG. 4 to FIG. 6. The vessel body 30 of the present embodiment is made of a synthetic resin material as an example. The vessel body 30 has a storage vessel part 40 and a lid part 41. The storage vessel part 40 is formed in a box shape including sidewalls 43F, 43B, 43L, and 43R vertically installed around a bottom part 42 (see FIG. 5) and having an opened upper surface. The lid part 41 is provided in order to seal the upper surface of the storage vessel part 40. Inside the vessel body 30, a storage room R1 is formed to store toner (see FIG. 5 to FIG. 7).

As illustrated in FIG. 7, the bottom part 42 has a stirring concave portion 42*a* and a conveying concave portion 42*b* curved to be convex downward in the front view. The stirring concave portion 42*a* is continuously provided at the left side of the conveying concave portion 42*b* and is formed to be larger than the conveying concave portion 42*b* in the right and left direction in the front view. At a rear lower surface of the conveying concave portion 42*b*, the discharge port 30*a* is opened (see FIG. 6). The discharge port 30*a* passes through the conveying concave portion 42*b* in the up and down direction. In addition, the discharge port 30*a* is formed at a rear side portion of the vessel body 30 in the front and rear direction.

At the upper end portions of the sidewalls 43F, 43B, 43L, and 43R, a vessel side flange 431 is formed to extend outward in the plan view (see FIG. 5 to FIG. 7). In the front sidewall 43F, a filling port 44 for filling toner in the vessel body 30 (the storage room R1) is opened (see FIG. 6). The filling port 44 is sealed by a cap 432 (see FIG. 6). The front sidewall 43F is mounted with a cover 433 to cover the filling port 44 (see FIG. 3).

As illustrated in FIG. 6, the front sidewall 43F is provided with a stirring bearing boss 45 and a conveying bearing boss 46 (an example of a slide bearing). The stirring bearing boss 45 protrudes from an outer surface (a front surface) of the sidewall 43F in a cylindrical shape. The stirring bearing boss 45 is provided in the vicinity of a curvature center of the stirring concave portion 42*a* in the front view (not illustrated).

Figure 8:
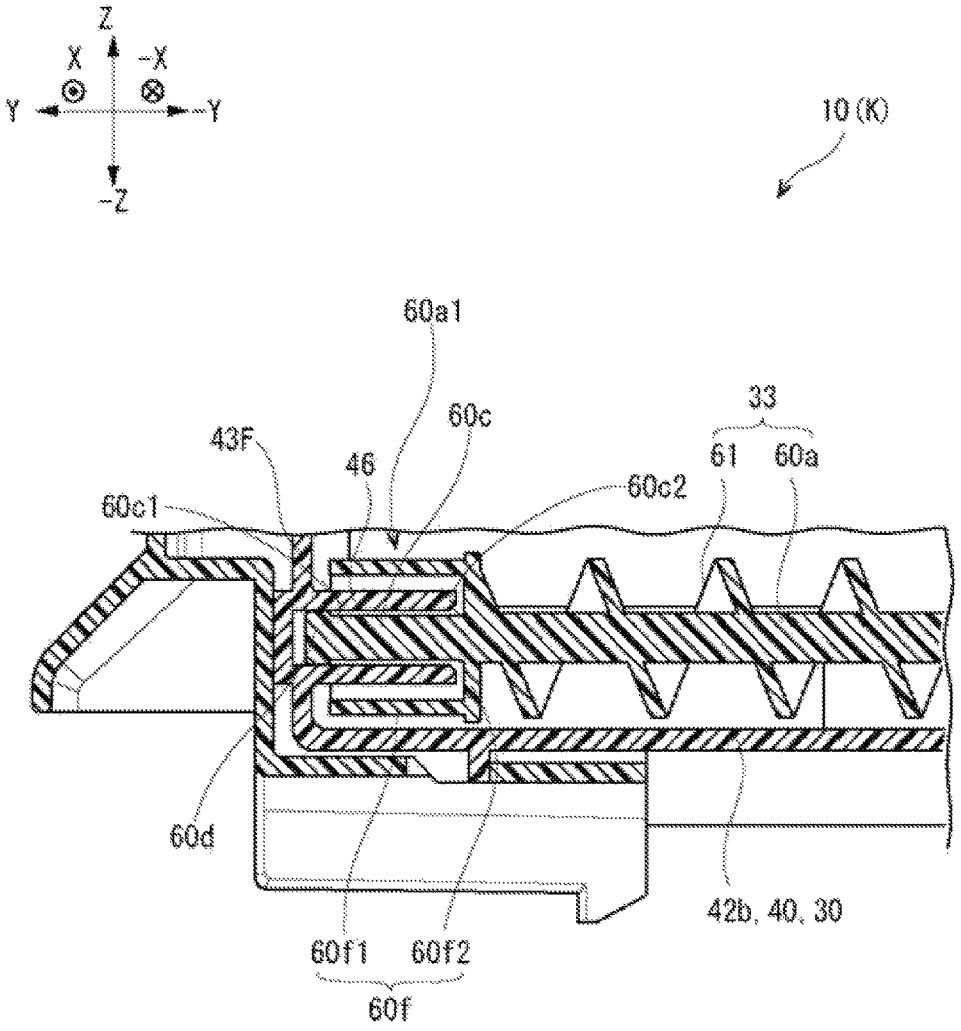
FIG. 8 is an enlarged view of a part surrounded by a dashed line of FIG. 6.

The conveying bearing boss 46 protrudes from the outer surface (the front surface) of the sidewall 43F in a cylindrical shape, and protrudes from an inner surface (a rear surface) of the sidewall 43F in a cylindrical shape (see FIG. 6 and FIG. 8). Furthermore, in the conveying bearing boss 46, an end of the outer surface of the sidewall 43F is closed and an end of the inner surface of the sidewall 43F is opened. From the above, a part of the conveying bearing boss 46 is provided inside the vessel body 30. In addition, the conveying bearing boss 46 surrounds a frond end portion (one end side portion 60*a*1) in the front and rear direction of a rotating shaft 60*a* constituting the conveying member 33, which will be described later, (see FIG. 6 and FIG. 8). The conveying bearing boss 46 is provided in the vicinity of a curvature center of the conveying concave portion 42*b* in the front view (see FIG. 7).

In the rear sidewall 43B, a stirring support hole 47 and a conveying support hole 48 are opened (see FIG. 6). The stirring support hole 47 is provided in the vicinity of the curvature center of the stirring concave portion 42*a* in the front view (not illustrated). Furthermore, the conveying support hole 48 is provided in the vicinity of the curvature center of the conveying concave portion 42*b* in the front view (not illustrated).

Figure 3:
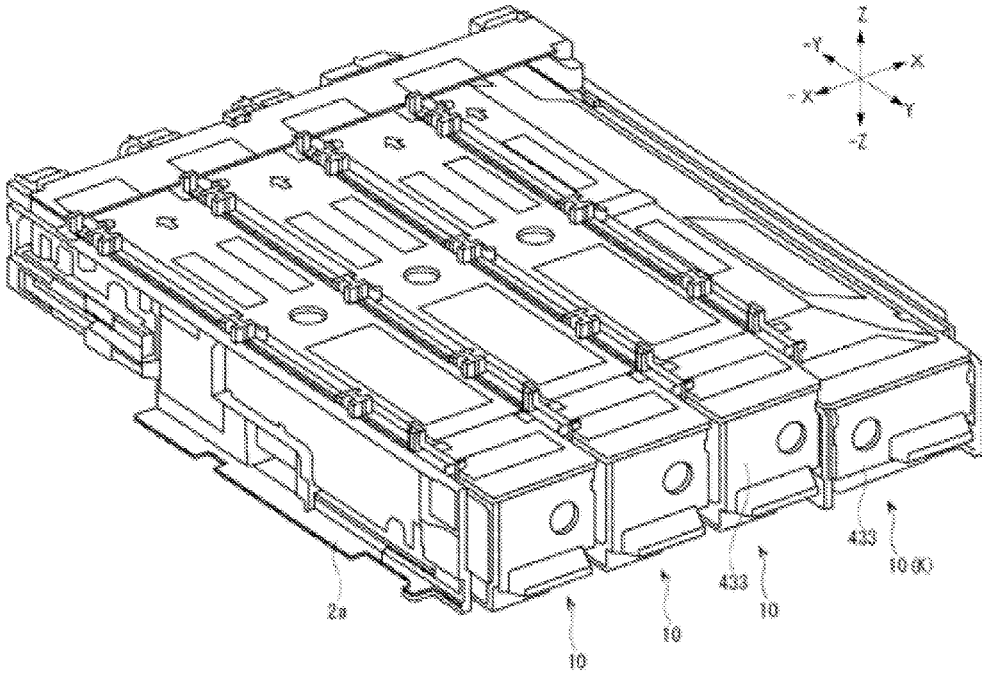
FIG. 3 is a perspective view of a toner container and a mounting part constituting an image forming apparatus of a first embodiment.

As illustrated in FIG. 3, the lid part 41 forms a shape approximately equal to that of the storage vessel part 40 in the plan view. Below the lid part 41, a lid-side flange 411 is formed across the entire circumference (see FIG. 6 and FIG. 7). The lid-side flange 411 is overlappingly arranged on the vessel side flange 431. Both flanges 411 and 431 are bonded to each other by an adhesive (or welding processing), so that the lid part 41 is fixed to the storage vessel part 40 (see FIG. 6 and FIG. 7).

[Shutter Mechanism]

The shutter mechanism 31 has a holding member 50 and a shutter 51 as illustrated in FIG. 6.

The holding member 50 is formed in a box shape which is flat in the up and down direction and has an opened upper surface. The holding member 50 is mounted at the lower surface of the conveying concave portion 42*b* so as to cover the periphery of the discharge port 30*a*. Between the bottom surface of the holding member 50 and the lower surface of the conveying concave portion 42*b*, an arrangement space S is formed in order to arrange the shutter 51 and the like. The holding member 50 is formed with a first communication hole 50*a* in a position corresponding to the discharge port 30*a* in the bottom view. The first communication hole 50*a* passes through the holding member 50 in the up and down direction.

The shutter 51 is formed in a rectangular plate shape in the plan view. To an upper surface of the shutter 51, a seal 52 made of synthetic rubber and the like is fixed. The shutter 51 is held in the arrangement space S in a slidable state in the front and rear direction. The shutter 51 (the seal 52) is formed at a part (a rear side) thereof with a second communication hole 51*a* that passes through the shutter 51 in the up and down direction. The shutter 51 is slidably provided between an opened position (see FIG. 6) in which the second communication hole 51*a* is allowed to coincide with the discharge port 30*a* and a closed position in which the second communication hole 51*a* is shifted from the discharge port 30*a*.

The holding member 50 is provided with an urging member that urges the shutter 51 and the like toward the closed position (not illustrated). Therefore, in a state where the toner container 10 has been detached from the mounting part 2*a*, the shutter 51 is maintained in a state where the shutter 51 has moved to the closed position, and the seal 52 closely contacts with the peripheral edge portion of the discharge port 30*a*. In this way, it is possible to prevent toner from being leaked from the discharge port 30*a*. On the other hand, in the course of mounting the toner container 10 at the mounting part 2*a*, the shutter 51 is engaged with an engaging part (not illustrated) provided to the mounting part 2*a*, thereby moving from the closed position to the opened position (see FIG. 6). In this way, the discharge port 30*a* is connected to a toner conveyance path (not illustrated) extending from the developing device 22 via the communication holes 50*a* and 51*a*. Then, toner discharged from the discharge port 30*a*, that is, dropped toner is supplied to the developing device 22 through the toner conveyance path.

[Stirring Member]

As illustrated in FIG. 6 and FIG. 7, the stirring member 32 is arranged in the second cylindrical part 35 serving as the upper side of the stirring concave portion 42*a*. The stirring member 32 has a stirring rotating shaft 55, a stirring blade 56, and a stirring connection member 57. The stirring rotating shaft 55 is supported in the vessel body 30 so as to be rotatable around the shaft. The stirring blade 56 is fixed along the longitudinal direction of the stirring rotating shaft 55. The stirring connection member 57 is provided on the same axis center as that of the stirring rotating shaft 55.

The stirring rotating shaft 55 is made of a synthetic resin material in a long rod shape in the front and rear direction as an example. The stirring rotating shaft 55 has a rectangular shape in the front view (the sectional view). The stirring rotating shaft 55 is installed between a pair of the front and rear sidewalls 43F and 43B. A front end portion of the stirring rotating shaft 55 is fitted into the stirring bearing boss 45. A rear end portion of the stirring rotating shaft 55 is rotatably connected to the stirring support hole 47 via the stirring connection member 57.

The stirring blade 56 is formed in a rectangular shape long in the front and rear direction by a flexible synthetic resin film. The stirring blade 56 is formed to have a length approximately equal to that of the stirring rotating shaft 55. One side of the stirring blade 56 in the longitudinal direction is fixed to the stirring rotating shaft 55 (see FIG. 7). A width dimension (a radial dimension of the stirring rotating shaft 55) of the stirring blade 56 is set to be longer than a distance for connecting the axis center of the stirring rotating shaft 55 and the inner surface of the stirring concave portion 42*a* (see FIG. 7). Furthermore, the stirring blade 56 is formed with a plurality of cut grooves 56*a* (see FIG. 6). Each of the cut grooves 56*a* is formed across a fixed side with the stirring rotating shaft 55 from a free end of the stirring blade 56.

The stirring connection member 57 has a stirring gear 57*a* and a stirring connection shaft 57*b* as illustrated in FIG. 5 and FIG. 6. The stirring gear 57*a* is a so-called spur gear and is arranged along the rear surface of the sidewall 43B. Details will be described later; however, the stirring gear 57*a* is configured to be rotationally driven by a driving motor (not illustrated) provided inside the apparatus body 2. The stirring connection shaft 57*b* protrudes to the rotation axis center of the stirring gear 57*a*. The stirring connection shaft 57*b* is rotatably supported in the stirring support hole 47 in a state where the stirring connection shaft 57*b* has been inserted into the stirring support hole 47 of the sidewall 43B from the rear. A distal end portion (a front end portion) of the stirring connection shaft 57*b* is connected to the rear end portion (the axis center) of the stirring rotating shaft 55 so as not to be rotatable.

[Conveying Member]

The conveying member 33 has a function of rotating in a predetermined direction around the shaft and conveying the toner in the vessel body 30, in other words, the toner in the first cylindrical part 34 from the front side (one end side) to the rear side (the other end side) in the front and rear direction. The predetermined direction around the shaft indicates a counterclockwise direction when the conveying member 33 is viewed from the front side in the front and rear direction (the axial direction). The conveying member 33 is arranged above the conveying concave portion 42*b* as illustrated in FIG. 6 and FIG. 7.

The conveying member 33 has a conveying rotating shaft 60, a spiral blade 61 (an example of a spiral part), a reverse spiral blade 62, a conveying connection member 63, and a cylindrical wall 60*f* (an example of a wall). The conveying rotating shaft 60 is supported in the vessel body 30 so as to be rotatable around the shaft. The spiral blade 61 is provided across the rear side from the front side of the conveying rotating shaft 60 in the front and rear direction (see FIG. 6). Furthermore, the reverse spiral blade 62 is provided at a rear side part in the front and rear direction than the spiral blade 61 in the conveying rotating shaft 60 (see FIG. 6). The conveying connection member 63 is provided on the same axis center as that of the conveying rotating shaft 60. The cylindrical wall 60*f* will be described later.

The conveying rotating shaft 60 is made of a synthetic resin material in a round rod shape long in the front and rear direction as an example. The conveying rotating shaft 60 is installed between the pair of front and rear sidewalls 43F and 43B. The conveying rotating shaft 60 is integrally formed by a rotating shaft 60*a* (an example of a shaft body) and a fitting shaft 60*b*.

The rotating shaft 60*a* extends from the front end portion to the vicinity of the discharge port 30*a*. The front end portion of the rotating shaft 60*a* is rotatably supported to the conveying bearing boss 46. The fitting shaft 60*b* is continuously provided at the rear end portion of the rotating shaft 60*a*. The fitting shaft 60*b* has the same axis center as that of the rotating shaft 60*a* and is formed in a hollow cylindrical shape thicker than the rotating shaft 60*a*. The fitting shaft 60*b* is rotatably supported to the conveying support hole 48 via the conveying connection member 63. A connection part between the rotating shaft 60*a* and the fitting shaft 60*b* is positioned above (near the front of) the discharge port 30*a* (see FIG. 6).

The conveying rotating shaft 60 is formed at the one end side portion 60*a*1 thereof with a recess 60*c* recessed across the whole circumference in the circumferential direction of the rotating shaft 60*a*. Specifically, as illustrated in FIG. 8, the recess 60*c* is formed in a range across a rear side position 60*c*2 in the front and rear direction than the distal end position of the conveying bearing boss 46 from a rear side position 60*c*1, except for a part 60*d* across the rear side position 60*c*1 than the front side end of the rotating shaft 60*a* in the front and rear direction. That is, at the rear side portion in the front and rear direction than the end of the one end side portion 60*a*1 of the rotating shaft 60*a*, the recess 60*c* recessed across the whole circumference in the circumferential direction of the rotating shaft 60*a* is formed. In other words, the recess 60*c* is (recessed by the same recessed amount to be) formed symmetrically to the axis center of the rotating shaft 60*a* in a range (as an example, a predetermined range across the position 60*c*2 from the position 60*c*1) in the axial direction of the rotating shaft 60*a*. The rotating shaft 60*a* of the present embodiment allows the part 60*d* across the position 60*c*1 from the front side end of the rotating shaft 60*a* in the front and rear direction to contact with the inner peripheral surface of the conveying bearing boss 46, thereby maintaining its posture.

The cylindrical wall 60*f* has a cylindrical shape, and serves as a wall that covers the conveying bearing boss 46 while surrounding the conveying bearing boss 46 across the whole circumference at a part of the one end side portion 60*a*1 side of the rotating shaft 60*a* as illustrated in FIG. 6 and FIG. 8. The cylindrical wall 60*f* has a cylindrical part 60*f*1 and a connection part 60*f*2. The cylindrical part 60*f*1 surrounds the outer side of the conveying bearing boss 46 across the whole circumference. The connection part 60*f*2 has a disc shape and connects the rotating shaft 60*a* and the cylindrical part 60*f*1 to each other. Specifically, the connection part 60*f*2 is provided to be symmetrical to the axis center of the rotating shaft 60*a* when viewed from the axial direction of the rotating shaft 60*a*. Furthermore, one end of the connection part 60*f*2 in the thickness direction is positioned in the aforementioned position 60*c*2. In a state where one end surface of the cylindrical part 60*f*1 is connected to the one end, the connection part 60*f*2 is connected to the cylindrical part 60*f*1. An outer diameter of the connection part 60*f*2 is larger than that of the cylindrical part 60*f*1. Therefore, a part of the outer diameter side of the connection part 60*f*2 protrudes than the cylindrical part 60*f*1 in the radial direction thereof (see FIG. 8). Furthermore, to the other end (a surface opposite to the one end surface) of the connection part 60*f*2, the end of the spiral blade 61 is connected.

The spiral blade 61 is integrally formed with the rotating shaft 60*a* by using a synthetic resin material as an example. The spiral blade 61 protrudes in the radial direction from the peripheral surface of the rotating shaft 60*a* and is formed in a spiral shape along the longitudinal direction of the rotating shaft 60*a*. Specifically, the spiral blade 61 is formed from the front end portion of the conveying rotating shaft 60 to the discharge port 30*a* (see FIG. 6).

The reverse spiral blade 62 is integrally formed with the fitting shaft 60*b* by using a synthetic resin material as an example. The reverse spiral blade 62 protrudes in the radial direction from the peripheral surface of the fitting shaft 60*b* and is formed in a 1 to 2 turn spiral shape. The reverse spiral blade 62 is formed such that a spiral direction is reverse (an opposite phase) to that of the spiral blade 61. The reverse spiral blade 62 is formed to have the same diameter as that of the spiral blade 61 in the front view. The reverse spiral blade 62 is provided to the peripheral surface of the fitting shaft 60*b* at the downstream side (the rear side) than the discharge port 30*a* (see FIG. 6). Above the discharge port 30*a*, the spiral blade 61 and the reverse spiral blade 62 are not provided (see FIG. 6).

[Conveying Connection Member]

The conveying connection member 63 has a conveying gear 63*a* and a conveying connection shaft 63*b* as illustrated in FIG. 6. The conveying gear 63*a* is a so-called spur gear and is arranged along the rear surface of the sidewall 43B. The conveying gear 63*a* is connected to a driving mechanism (not illustrated) including a driving motor, a gear train and the like that are provided inside the apparatus body 2. The conveying gear 63*a* is connected to the stirring gear 57*a* via an intermediate gear 63*c*. The conveying connection shaft 63*b* protrudes from the rotation axis center of the conveying gear 63*a*. The conveying connection shaft 63*b* is rotatably supported to the conveying support hole 48 in the state of being inserted into the conveying support hole 48 of the sidewall 43B from the rear. A distal end portion (a front end portion) of the conveying connection shaft 63*b* is fitted to a hollow interior of the fitting shaft 60*b* of the conveying rotating shaft 60 so as not to be rotatable.

The driving motor is configured to rotate the conveying gear 63*a* (the conveying connection shaft 63*b*). The conveying gear 63*a* is configured to rotate the stirring gear 57*a* (the stirring connection shaft 57*b*) via the intermediate gear 63*c*. In this way, the stirring connection member 57 and the stirring rotating shaft 55 are configured to integrally rotate around the same axis center. By so doing, the stirring blade 56 is configured to slide on the inner surface of the stirring concave portion 42*a* while being elastically curved. That is, the stirring blade 56 is configured to stir the toner in the storage room R1 while scraping toner attached to the inner surface of the stirring concave portion 42*a*. Similarly, the conveying connection member 63 and the conveying rotating shaft 60 are configured to integrally rotate around the same axis center. By so doing, the spiral blade 61 is configured to convey the toner stirred by the stirring member 32 toward the discharge port 30*a* (toward the rear side from the front side). When the toner is conveyed to the discharge port 30*a*, the toner is dammed by the rotation of the reverse spiral blade 62. In this way, the toner is moved to the discharge port 30*a*, is dropped from the discharge port 30*a*, and is discharged toward the exterior (the developing device 22) of the vessel body 30.

As described above, the spiral blade 61 is configured to allow conveying force toward the downstream side (the rear side) to act on toner, and the reverse spiral blade 62 is configured to allow conveying force toward the upstream side (the front side) to act on the toner. Furthermore, as described above, the fitting shaft 60*b* with the reverse spiral blade 62 fixed thereto is formed to have a diameter larger than that of the rotating shaft 60*a* with the spiral blade 61 fixed thereto. Therefore, the size of the conveying force of the spiral blade 61 is set to be larger than that of the conveying force of the reverse spiral blade 62.

[First Cylindrical Part]

As illustrated in FIG. 6, the first cylindrical part 34 is integrally formed with the rear end portion of the conveying concave portion 42*b* by using a synthetic resin material as an example. The first cylindrical part 34 is formed so as to cover the discharge port 30*a*. That is, the first cylindrical part 34 is formed in an approximately cylindrical shape in which it is integrally formed with the conveying concave portion 42*b* and extends in the front and rear direction. Inside the first cylindrical part 34, a conveyance room R2 is formed to include the rear end portion of the conveying member 33 so as to be rotatable. The inner diameter of the first cylindrical part 34 is formed to be slightly larger than the outer diameter of the spiral blade 61 of the conveying member 33.

The toner in the storage room R1 is configured to be sent into the first cylindrical part 34 (the conveyance room R2) by the conveying member 33 rotating and to be discharged toward the developing device 22 from the discharge port 30*a* (see FIG. 6). Since the discharge port 30*a* is covered by the first cylindrical part 34, an excessive amount of toner is not carried to the discharge port 30*a*. That is, the first cylindrical part 34 is provided in order to adjust an amount (a supply amount) of toner to be discharged from the discharge port 30*a*. In this way, it is possible to prevent excessive supply of toner to the developing device 22.

[Second Cylindrical Part]

As illustrated in FIG. 6, the second cylindrical part 35 is integrally formed with the storage vessel part 40 by using a synthetic resin material as an example. The second cylindrical part 35 is connected to the rear sidewall 43B and the right sidewall 43R and is connected to the upper part of the first cylindrical part 34. That is, the second cylindrical part 35 is formed in a rectangular cylindrical shape vertically extending from the upper peripheral surface of the first cylindrical part 34 along the sidewalls 43B and 43R. The second cylindrical part 35 communicates with the interior (the conveyance room R2) of the first cylindrical part 34 at the downstream side (the rear side) than the discharge port 30*a* (see FIG. 6). Specifically, the second cylindrical part 35 communicates with the first cylindrical part 34 in a position overlapping the rear side of the discharge port 30*a* in the side view.

Inside the second cylindrical part 35, an evacuation room R3 is formed to communicate with the conveyance room R2. That is, the evacuation room R3 expands the capacity of the conveyance room R2 upward. Between the upper end portion of the second cylindrical part 35 and the lower surface of the lid part 41, a gap 35*a* is formed as a through opening. The gap 35*a* is opened to the front side and the left side of the second cylindrical part 35. The gap 35*a* allows the evacuation room R3 and the storage room R1 to communicate with each other.

<Operation of Toner Container>

Figure 2:
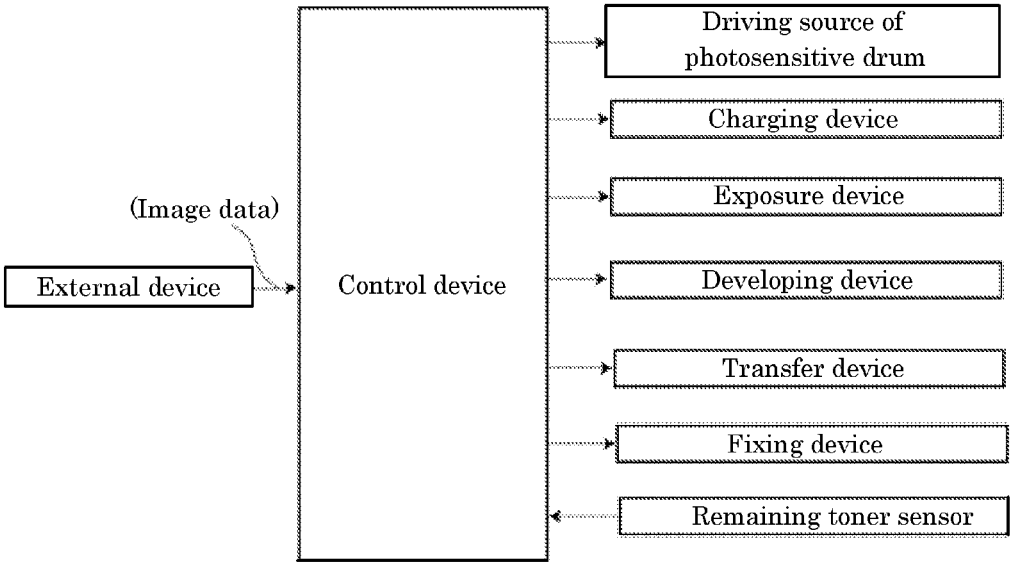
FIG. 2 is a block diagram illustrating a relation between a control device constituting an image forming apparatus of a first embodiment and each element constituting the image forming apparatus.

Next, an operation (a toner supply operation) of the toner container 10 will be described with reference to FIG. 2, FIG. 6, and FIG. 7. When toner of the developing device 22 is consumed by the execution of an image forming operation, the control device CU performs a toner supply operation with respect to the developing device 22 as follows. The driving motor is driven by the control device CU to rotate the stirring member 32 and the conveying member 33. The conveying member 33 conveys toner stirred by the stirring member 32 toward the discharge port 30*a*. In this way, the toner is introduced to the conveyance room R2 of the first cylindrical part 34, is dropped from the opened discharge port 30*a*, and is supplied to the developing device 22 via the toner conveyance path (see the thick solid line arrow of FIG. 6). In addition, a remaining toner sensor (not illustrated) is arranged in the developing device 22, and when the control device CU is notified of the fact that an amount of toner in the developing device 22 has reached a predetermined amount from the remaining toner sensor (see FIG. 2), the control device CU allows the toner supply operation for the toner container 10 to be ended.

Effect

Next, effects of the present embodiment will be described with reference to the drawings.

[First Effect]

Figure 9:
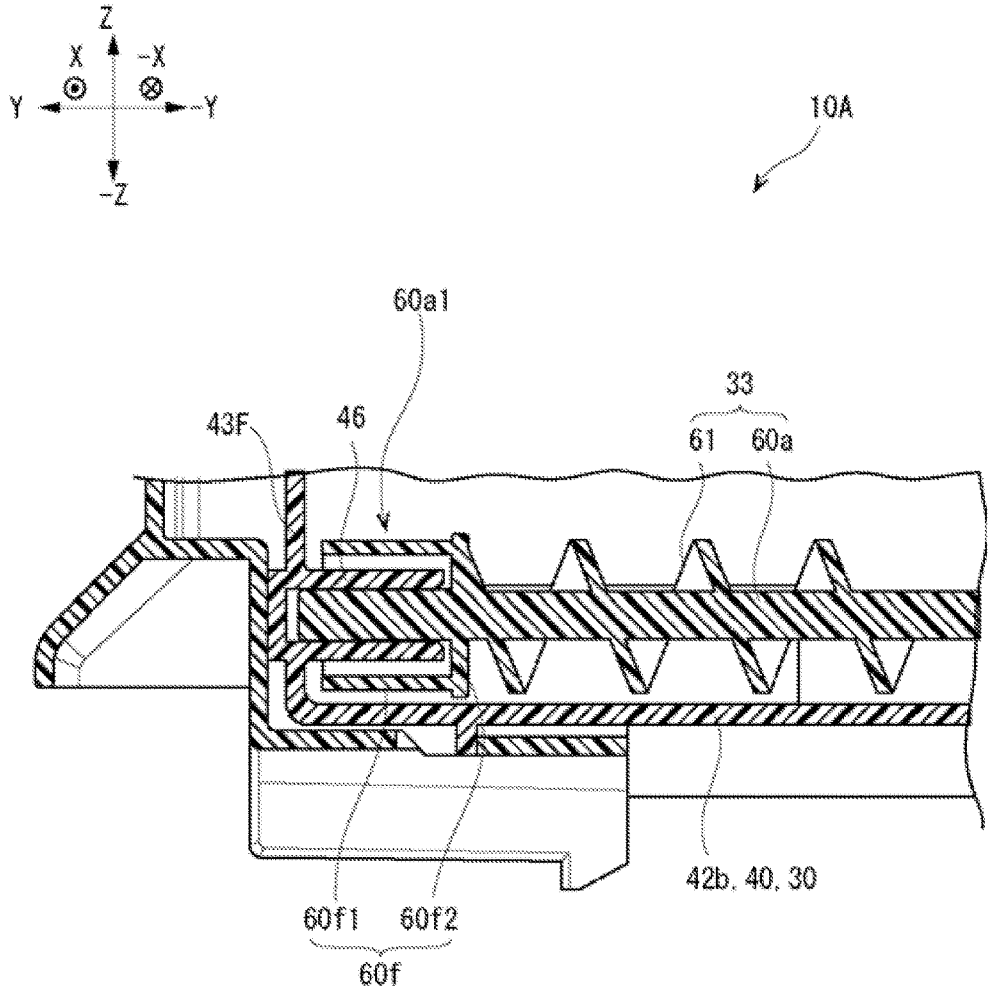
Fig.9 Related Art
FIG. 9 is a sectional view of a part of a toner container of a comparative example.

For example, in the case of a comparative example illustrated in FIG. 9 (a toner container 10A), the recess 60*c* is not formed in the one end side portion 60*a*1 of the rotating shaft 60*a*. Therefore, in this comparative example, an entire of the one end side portion 60*a*1 contacts with the inner peripheral surface of the conveying bearing boss 46, so that the rotating shaft 60*a* maintains its own posture.

However, in the case of the present embodiment, as illustrated in FIG. 8, the recess 60*c* is formed in the one end side portion 60*a*1 of the rotating shaft 60*a*. Furthermore, in the present embodiment, the part 60*d* at the one end side portion 60*a*1 is allowed to contact with the inner peripheral surface of the rotating shaft 60*a*, so that its posture is maintained. That is, in the present embodiment, as compared with the aforementioned comparative example, a contact area of the rotating shaft 60*a* with respect to the inner peripheral surface of the conveying bearing boss 46 is small.

Consequently, in the rotating shaft 60*a* of the present embodiment, a rotational load received from the conveying bearing boss 46 is small as compared with the aforementioned comparative example. Therefore, in the toner container 10 of the present embodiment, abrasion of the one end side portion 60*a*1 of the rotating shaft 60*a* with the rotation around the shaft is suppressed. Furthermore, the lifespan of the toner supply device 100 and the image forming apparatus 1 of the present embodiment is long because the abrasion of the one end side portion 60*a*1 of the rotating shaft 60*a* is suppressed. In addition, as with the present embodiment, when the rotating shaft 60*a* is made of synthetic resin, the aforementioned effect is more considerable.

[Second Effect]

The conveying bearing boss 46 of the present embodiment is covered by the cylindrical wall 60*f* from its opening side. Therefore, in the case of the present embodiment, for example, as compared with the case where there is no cylindrical wall 60*f*, toner is difficult to enter into a gap between the outer peripheral surface of the one end side portion 60*a*1 of the rotating shaft 60*a* and the inner peripheral surface of the conveying bearing boss 46. In addition, in the present embodiment, even though the rotating shaft 60*a* is elastically deformed, the one end side portion 60*a*1 of the rotating shaft 60*a* is difficult to be detached from the conveying bearing boss 46 as compared with the case where there is no cylindrical wall 60*f*.

Second Embodiment

Figure 10:
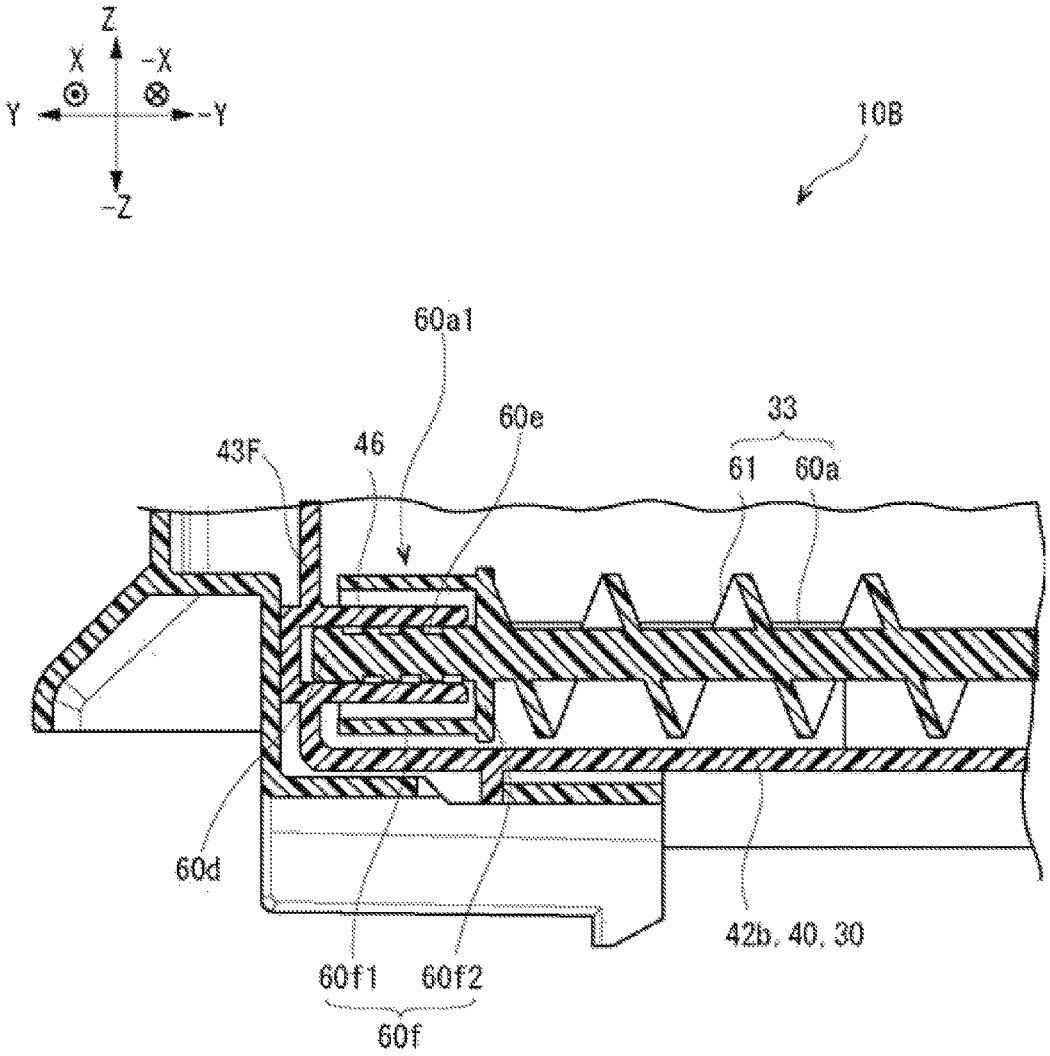
FIG. 10 is a sectional view of a part of a toner container of a second embodiment.

Next, a second embodiment will be described with reference to FIG. 10. In the following description, the present embodiment will be described while focusing on the difference with the first embodiment. When the present embodiment uses the same elements as those of the first embodiment, the same names, reference numerals and the like are used.

<Configuration and Operation>

In the case of a toner container 10B of the present embodiment, a recess 60*e* of one end side portion 60*a*1 of a rotating shaft 60*a* has a spiral shape with respect to the axial direction of the rotating shaft 60*a*. Furthermore, the recess 60*e* of the present embodiment is inclined in the same direction as that of a spiral blade 61 with respect to the rotation direction of the rotating shaft 60*a*. The toner container 10B of present embodiment has a configuration similar to that of the first embodiment except for the aforementioned point (see FIG. 4 to FIG. 8 and the like).

Effect

For example, in the case of the first embodiment, toner may enter into the gap between the outer peripheral surface of the one end side portion 60*a*1 of the rotating shaft 60*a* and the inner peripheral surface of the conveying bearing boss 46. Moreover, the toner entering into the gap may adhere to the one end side portion 60*a*1. As a consequence, a rotational load of the rotating shaft 60*a* received from the conveying bearing boss 46 becomes large.

Also in the case of the present embodiment, similarly to the case of the first embodiment, toner may enter into the gap between the outer peripheral surface of the one end side portion 60*a*1 of the rotating shaft 60*a* and the inner peripheral surface of the conveying bearing boss 46. However, in the present embodiment, the recess 60*e* formed in the one end side portion 60*a*1 has a spiral shape inclined in the same direction as that of the spiral blade 61. Therefore, in the present embodiment, toner entering into the aforementioned gap with the rotation of the rotating shaft 60*a* is easily discharged to an exterior from the conveying bearing boss 46 by the spiral recess 60*e*.

Consequently, according to the present embodiment, as compared with the first embodiment, toner is difficult to remain in the gap between the outer peripheral surface of the one end side portion 60*a*1 of the rotating shaft 60*a* and the inner peripheral surface of the conveying bearing boss 46. Accordingly, in the case of the present embodiment, as compared with the first embodiment, abrasion of the one end side portion 60*a*1 of the rotating shaft 60*a* with the rotation around the shaft is suppressed. Furthermore, adhesion of toner to the one end side portion 60*a*1 of the rotating shaft 60*a* is suppressed. The other effects of the present embodiment are similar to those of the first embodiment.

So far, the technical scope of the present disclosure has been described employing the first and second embodiments as examples; however, the technical scope of the present disclosure is not limited to these embodiments. For example, the technical scope of the present disclosure also includes the following examples.

Figure 11A:
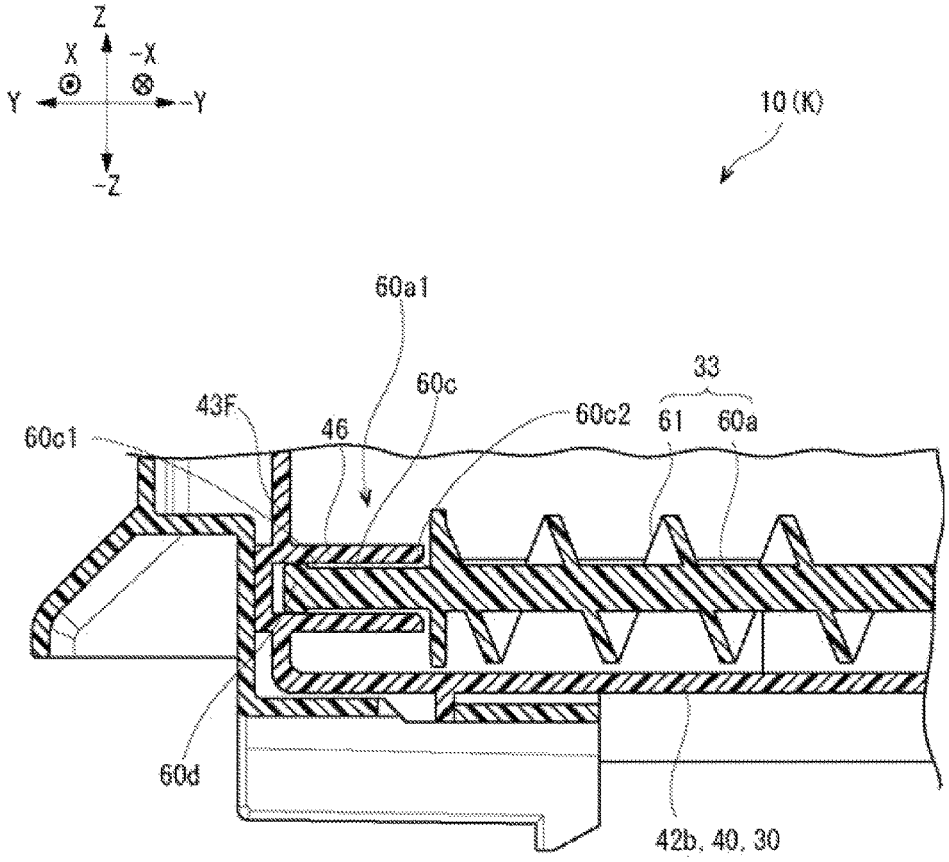
FIG. 11A is a sectional view of a part of a toner container of a modification example (a first modification example).
Figure 11B:
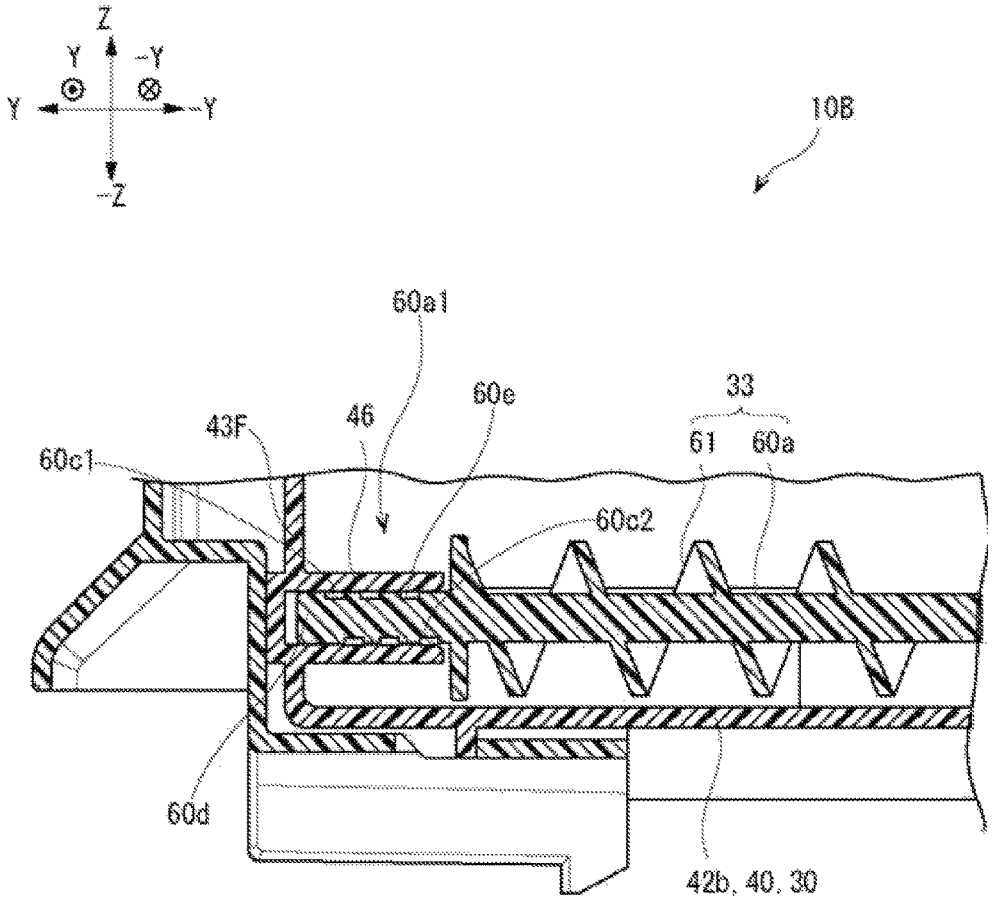
FIG. 11B is a sectional view of a part of a toner container of a modification example (a second modification example).

For example, each embodiment has been described on the assumption that the cylindrical wall 60*f* is provided to the conveying member 33. However, for example, as with a modification example (a first modification example) of FIG. 11A and a modification example (a second modification example) of FIG. 11B, the cylindrical wall 60*f* may not be provided to the conveying member 33. Also in these cases, the first modification example achieves the aforementioned first effect and the second modification example achieves the aforementioned first and second effects.

For example, each embodiment has been described on the assumption that an example of the wall has a cylindrical shape. However, the example of the wall may not have the cylindrical shape if the wall has a configuration for covering the conveying bearing boss 46 while surrounding the conveying bearing boss 46.

Figure 12A:
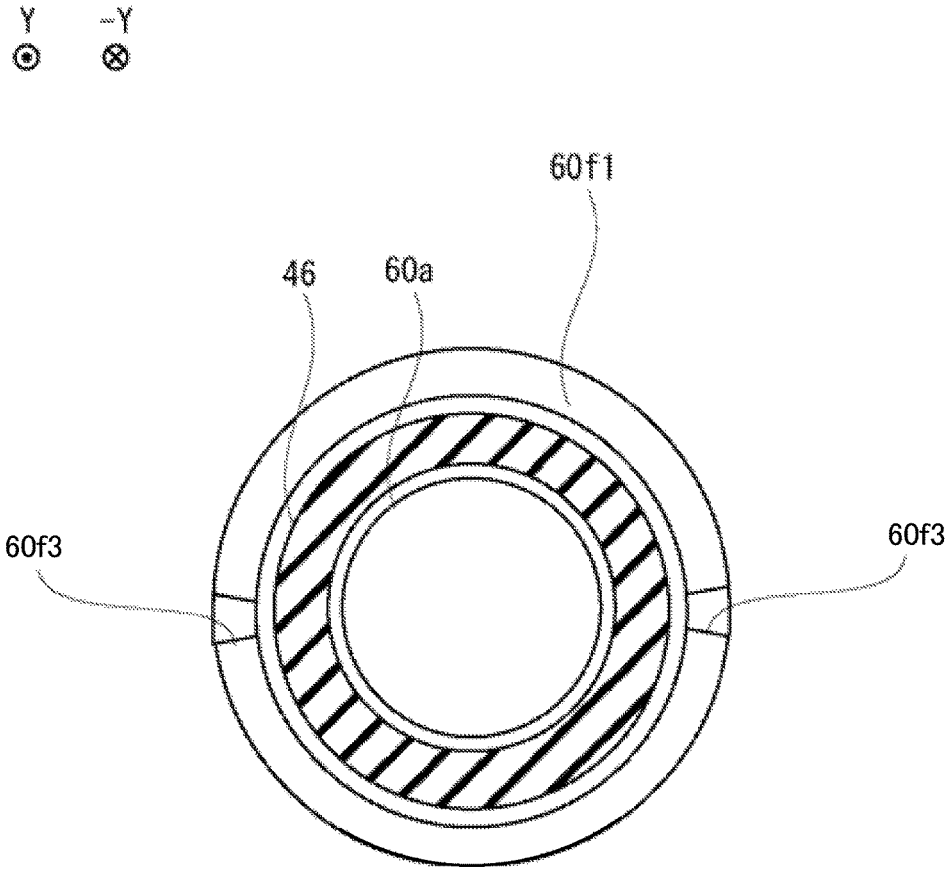
FIG. 12A is a sectional view illustrating a part of a toner container of a modification example (a third modification example).
Figure 12B:
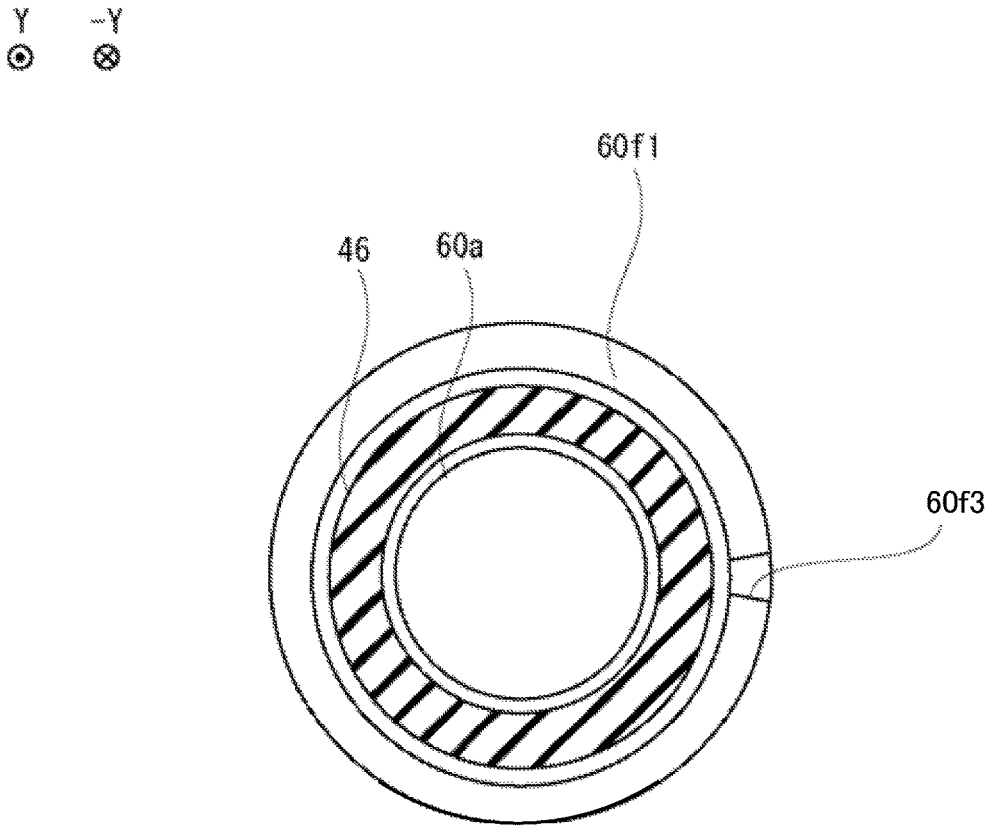
FIG. 12B is a sectional view illustrating a part of a toner container of a modification example (a fourth modification example).

Furthermore, each embodiment has been described on the assumption that an example of the wall facing the conveying bearing boss 46 is the cylindrical wall 60*f* having a cylindrical shape and surrounding the outer side of the conveying bearing boss 46 across the whole circumference. However, the wall may not surround the outer side of the conveying bearing boss 46 across the whole circumference if the wall faces the conveying bearing boss 46. For example, as with a wall 60*f*1 of a modification example (a third modification example) of FIG. 12A, a plurality of cuts 60*f*3 (slits) may be formed at a part of the cylindrical wall surrounding the outer side of the conveying bearing boss 46 across the whole circumference. Furthermore, as with a wall 60*f*1 of a modification example (a fourth modification example) of FIG. 12B, one cut 60*f*3 (a slit) may be formed at a part of the cylindrical wall surrounding the outer side of the conveying bearing boss 46 across the whole circumference. Moreover, although not illustrated in the drawing, differently from the modification examples of FIG. 12A and FIG. 12B, a range between the wall 60*f*1 and the cut 60*f*3 may be a reverse relation.

What is claimed is:

1. A toner case comprising:

an accommodating unit that accommodates toner;

a conveying member that is arranged in the accommodating unit, has a shaft body and a spiral part protruding in a spiral shape from one end side to the other end side of the shaft body, has a recess across whole circumference in a circumferential direction at a portion of the other end side than an end of one end side portion of the shaft body, and rotates in a predetermined direction to convey the toner from the one end side to the other end side, the one end side facing the other end side; and a slide bearing that is provided in the accommodating unit, has a cylindrical shape, and surrounds the one end side portion, wherein the recess has a spiral shape, and moves the toner in the recess from the one end side to the other end side with rotation of the shaft body in the predetermined direction.

2. The toner case of claim 1, wherein a wall is provided to a portion of the one end side of the shaft body to cover the slide bearing.

3. The toner case of claim 2, wherein the wall covering the slide bearing has a cylindrical shape and surrounds the slide bearing across whole circumference.

4. An image forming apparatus comprising:

a carrying member that carries a latent image;

the toner case of claim 1;

a developing device that develops the latent image carried by the carrying member as a toner image by using toner supplied from the toner case;

a transfer device that transfers the toner image developed to the carrying member by the developing device to a medium; and a fixing device that fixes the toner image, which has been transferred to the medium, to the medium.

5. A toner case comprising:

an accommodating unit that accommodates toner;

a conveying member that is arranged in the accommodating unit, has a shaft body and a spiral part protruding in a spiral shape from one end side to the other end side of the shaft body, has a recess across whole circumference in a circumferential direction at a portion of the other end side than an end of one end side portion of the shaft body, and rotates in a predetermined direction to convey the toner from the one end side to the other end side, the one end side facing the other end side; and a slide bearing that is provided in the accommodating unit, has a cylindrical shape, and surrounds the one end side portion, wherein a wall is provided to a portion of the one end side of the shaft body to cover the slide bearing, and the wall covering the slide bearing has a cylindrical shape and surrounds the slide bearing across whole circumference.

6. An image forming apparatus comprising:

a carrying member that carries a latent image;

the toner case of claim 5;

a developing device that develops the latent image carried by the carrying member as a toner image by using toner supplied from the toner case;

a transfer device that transfers the toner image developed to the carrying member by the developing device to a medium; and a fixing device that fixes the toner image, which has been transferred to the medium, to the medium.

* * * * *